US009366154B2

(12) United States Patent
Bourget

(10) Patent No.: US 9,366,154 B2
(45) Date of Patent: Jun. 14, 2016

(54) METHOD FOR THE AUTOMATED DETECTION OF THE INGESTION OF AT LEAST ONE FOREIGN BODY BY A GAS TURBINE ENGINE

(75) Inventor: Sebastien Bourget, Torunan en Brie (FR)

(73) Assignee: SNECMA, Paris (FR)

( * ) Notice: Subject to any disclaimer, the term of this patent is extended or adjusted under 35 U.S.C. 154(b) by 700 days.

(21) Appl. No.: 13/577,455

(22) PCT Filed: Feb. 2, 2011

(86) PCT No.: PCT/FR2011/050205

§ 371 (c)(1),
(2), (4) Date: Aug. 7, 2012

(87) PCT Pub. No.: WO2011/095737

PCT Pub. Date: Aug. 11, 2011

(65) Prior Publication Data

US 2012/0303330 A1 Nov. 29, 2012

(30) Foreign Application Priority Data

Feb. 8, 2010 (FR) ..... 10 50870

(51) Int. Cl.
*F01D 21/04* (2006.01)
*F01D 21/00* (2006.01)

(52) U.S. Cl.
CPC ..... *F01D 21/045* (2013.01); *F01D 21/003* (2013.01)

(58) Field of Classification Search
CPC ..... F01D 21/045; F01D 21/003
USPC ..... 702/190
See application file for complete search history.

(56) References Cited

U.S. PATENT DOCUMENTS 4,888,948 A 12/1989 Fisher et al.
6,098,022 A 8/2000 Sonnichsen et al.

(Continued)

FOREIGN PATENT DOCUMENTS

EP 0 284 392 9/1988
EP 1 312 766 5/2003

(Continued)

OTHER PUBLICATIONS

J. M. Barragan, "Ageing Mechanisms and Control: Part B—Monitoring and Management of Gas Turbine Fleets for Extended Life and Reduced Costs", Manchester, UK Oct. 8-11, 2001, and published in RTO-MP-079(I).*

"Eurofigher Technology and Performance : Propulsion", http://typhoon.starstreak.net/Eurofighter/engines.html, Jul. 31, 2010. Accessed Mar. 3, 2015.*

(Continued)

*Primary Examiner* — Mohamed Charioui
*Assistant Examiner* — Catherine Rastovski
(74) *Attorney, Agent, or Firm* — Oblon, McClelland, Maier & Neustadt, L.L.P.

(57) ABSTRACT

A method for automated detection of ingestion of at least one foreign body by a gas turbine engine, according to which: instantaneous speed of the rotor is measured; a speed signal of the rotor is filtered to separate a static component from a dynamic component thereof; the filtered dynamic component is compared to a standard resonance wave of the rotor to obtain an ingestion indicator, the standard resonance wave corresponding to the vibrational impulse response of a rotor; the obtained ingestion indicator is compared with a detection threshold; and a foreign body ingestion detection signal is emitted when the ingestion indicator is higher than the detection threshold.

10 Claims, 2 Drawing Sheets

(56) References Cited

U.S. PATENT DOCUMENTS

| | | | | |
|---|---|---|---|---|
| 6,456,945 | B1 | 9/2002 | Sonnichsen et al. | |
| 6,584,338 | B1 * | 6/2003 | Van Muiswinkel | 600/419 |
| 6,668,655 | B2 * | 12/2003 | Harrold et al. | 73/660 |
| 2004/0060347 | A1 * | 4/2004 | Comperat et al. | 73/66 |
| 2005/0129498 | A1 * | 6/2005 | Brooks | 415/1 |
| 2007/0250245 | A1 * | 10/2007 | van der Merwe et al. | 701/100 |
| 2010/0133828 | A1 * | 6/2010 | Stegemann et al. | 290/44 |

FOREIGN PATENT DOCUMENTS

| | | |
|---|---|---|
| FR | 2 840 358 | 12/2003 |
| WO | 99 20992 | 4/1999 |

OTHER PUBLICATIONS

International Search Report Issued Apr. 6, 2011 in PCT/FR11/50205 Filed Feb. 2, 2011.

* cited by examiner

METHOD FOR THE AUTOMATED DETECTION OF THE INGESTION OF AT LEAST ONE FOREIGN BODY BY A GAS TURBINE ENGINE

BACKGROUND OF THE INVENTION

1. Field of the Invention

The present invention relates to a device and a method to detect an impact on a blade of a gas turbine engine, in particular a blower blade.

2. Description of the Related Art

A gas turbine engine when it is mounted on an aircraft can be damaged by objects being sucked by the engine upon its use. Such objects can have various shapes, for example, birds, stones or ice.

After the objects being sucked, the latter circulate from upstream to downstream in the engine, while striking different engine elements. Such phenomenon is known as "ingestion of foreign bodies."

Depending on the nature, the density and the relative speed of the bodies ingested by the engine, some parts of the engine can be more or less damaged.

In order to keep a high degree of safety and reliability of the engine upon its use, it is necessary to detect the damages generated by such ingestions so as to repair or replace the engine elements being damaged.

For commercial flights having passengers, the gas turbine engines are visually inspected before each flight. This inspection presents several drawbacks. First of all, this visual inspection cannot allow a totally reliable detection, since the operators cannot see small damages, the latter being difficult to notice. Secondly, when damage is detected, it is necessary to make immediately maintenance operations, thereby needing to immobilize the aircraft and, consequently, delaying the departure thereof. This later detection of the effects of an ingestion of a foreign body thus leads to trouble for the passengers who have to embark on said aircraft.

It is known from the Patent Application FR2840358 A1 from SNECMA to provide a damage detection system for a rotor of an aircraft engine, comprising measurements means for the vibration and the speed of the rotor upon a determined flight. However, such a system does not have the required precision to detect the ingestion of a foreign body.

It is known from the Patent Application EP 1312766 A2 from ROLLS-ROYCE to provide an impact detection method on a rotor blade, wherein the rotor speed fall is measured to emit an alarm. Such detection presents this drawback to be a little discriminating. Indeed, in case of an engine pumping, the rotor speed decreases and an alarm is emitted whereas no body has been ingested. In order to eliminate such drawback, the Patent Application EP 1312766 A2 learns to add sensors to measure the torsion angle of the engine and to thus improve the precision of the method. Such method, with numerous sensors, is not satisfactory and does not allow an ingestion of a foreign body to be detected on a precise and reliable way.

BRIEF SUMMARY OF THE INVENTION

In order to obviate such drawbacks, the invention relates to a method for the automated detection of the ingestion of at least one foreign body by a gas turbine engine comprising a rotor, a method wherein:

the instantaneous speed of the rotor is measured;

the speed signal of the rotor is filtered in order to separate the static component from the dynamic component thereof;

the filtered dynamic component is compared to a standard resonance wave so as to obtain an ingestion indicator, the standard resonance wave corresponding to the vibrational impulse response of a rotor;

the ingestion indicator being obtained is compared to a detection threshold; and a foreign body ingestion detection signal is emitted when the ingestion indicator is higher than the detection threshold.

The vibrational response of a rotor constitutes its signature further to an impact, that is to say further to an impulsion. The standard resonance wave means the vibrational impulsion response measured on the rotor further to the ingestion of a body by said rotor.

Thanks to the invention, the transient dynamic component of the rotor speed is compared to the signature thereof so as to detect an ingestion.

The method according to the invention is more discriminating than the method according to the prior art only based on an amplitude thresholding of the dynamic component of the rotor speed R(t), a dynamic component of a strong amplitude being able to have various causes.

Thanks to the invention, vibrations of an important amplitude (for example pumping) can be ignored when the form of the dynamic component of the rotor speed R(t) does not correspond to the one of a standard resonance wave. Moreover, it is possible to detect ingestions of so-called "weak energy" bodies (weak mass, weak speed) leading to vibrations of a weak amplitude, such detection being not possible with a method of the prior art.

Advantageously, such method is implemented with neither sensor addition nor structural modification.

Preferably, the standard resonance wave of the rotor corresponds to the impulsion response of the first torsion mode of the rotor.

Advantageously, the research in the filtered dynamic component of the impulsion response of the first torsion mode of the rotor, having a known characteristic, enables determination of a vibration corresponding to an ingestion.

Indeed, the impulsion response of the first torsion mode is only present further to a torsion transient excitation of the rotor, which is typical of an ingestion of a foreign body. Thus, an ingestion is detected on a reliable and precise way.

Still preferably, a convolution product between the filtered dynamic component and the standard resonance wave is implemented to obtain the ingestion indicator.

According to a first variation, the standard resonance wave is directly measured on the rotor of the engine on which the detection method is implemented.

So, the characteristics of the impulsion response of the first torsion mode of the rotor (frequency, cushioning) are determined in an experimental way.

According to a second variation, the standard resonance wave is theoretically defined as a function of the characteristics of the impulsion response of the first torsion mode of the rotor (frequency, cushioning, etc.).

Preferably, the rotor is a low pressure rotor of a gas turbine engine, the filtered dynamic component is compared to a standard resonance wave of the low pressure rotor so as to obtain an ingestion indicator, the standard resonance wave corresponding to the vibrational impulsion response of a low pressure rotor.

BRIEF DESCRIPTION OF THE SEVERAL VIEWS OF THE DRAWINGS

The invention will be better understood through the accompanying drawing, wherein.

DETAILED DESCRIPTION OF THE INVENTION

The invention relates to a precise detection method for the ingestion of a foreign body by a double body gas turbine engine comprising a low pressure rotor shaft and a high pressure rotor shaft, a blower being integrally mounted with the low pressure rotor.

Figure 1:
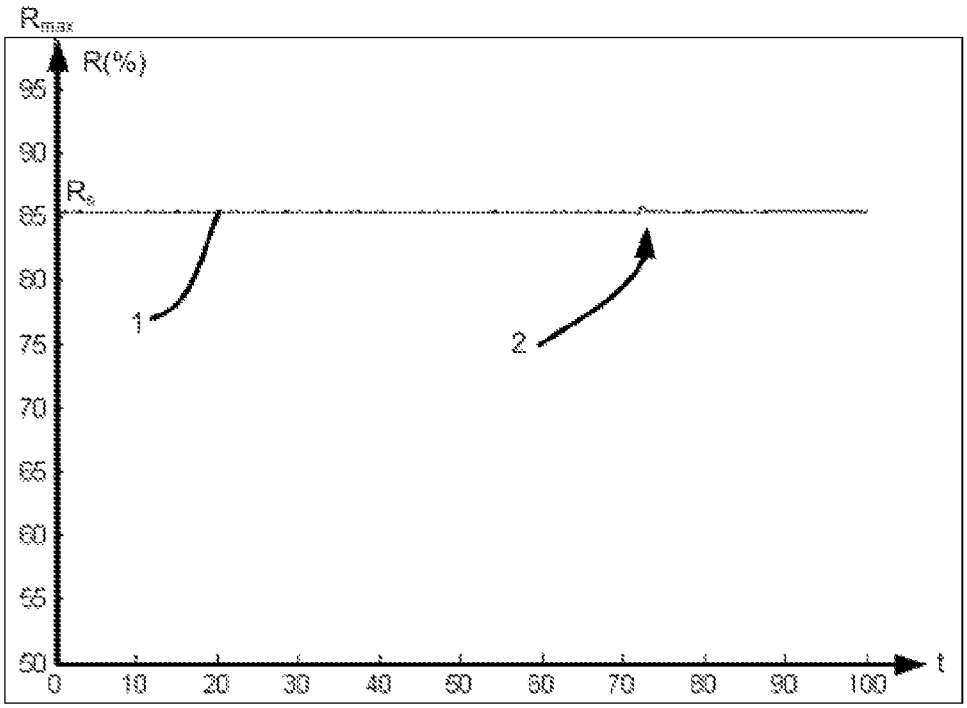
FIG. 1 represents a measurement of the low pressure rotor speed upon the time.
Figure 2:
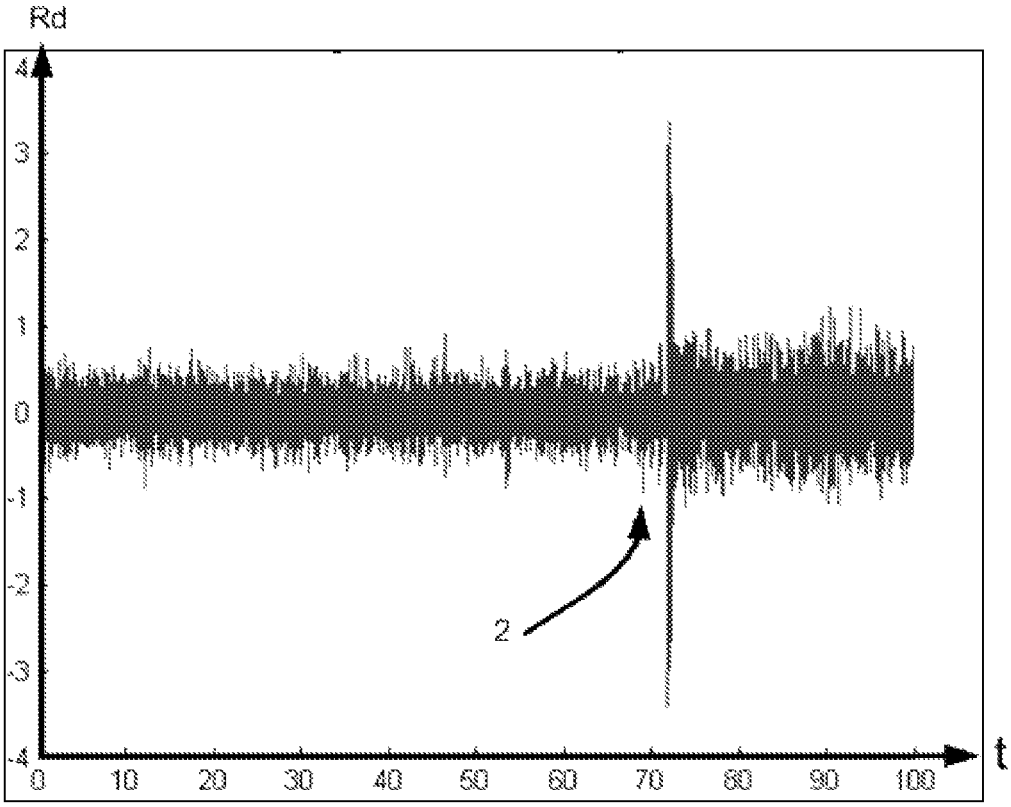
FIG. 2 represents the dynamic component of the low pressure rotor speed of FIG. 1.

Referring to FIG. 1, the rotation speed R(t) of the low pressure rotor is measured upon the time by means of a phonic wheel as known by the man of the art, being arranged to measure the angle speed of the low pressure rotor shaft. It goes without saying that the low pressure rotor speed could also be measured by other means, in particular, by accelerometers arranged in the engine.

Further to such measurement, a curve 1 being substantially constant upon the time around the static speed of the low pressure rotor R(s) is obtained. On FIG. 1, the rotation speed R(t) is standardized with respect to the maximum value of the low pressure rotor speed. On FIG. 1, the static speed R(s) of the low pressure rotor is of about 85% of the maximum speed.

Upon the measurement period, a body of a weak mass (about 50 g) is ingested by the engine. The curve 1 representing the speed of the blower R(t) presents an oscillation 2 upon the ingestion of the body by the engine, such oscillation being very weak, about 0.5% of the value of the static speed R(s). Such oscillation cannot be directly detected further to the measurement of the speed of the low pressure rotor R(t). Indeed, such oscillations can be related to measurement noise or to other phenomena than the ingestion, in particular the engine pumping phenomena.

It is known that the speed (R(t) of the low pressure rotor measured by the phonic wheel has a static component Rs and a dynamic component Rd(t) and can be shared under the following form:

$$R(t)=Rs+Rd(t) \quad (1)$$

To highlight the oscillation 2, the low pressure rotor speed R(t) is filtered so as to keep only the dynamic component Rd(t) of the signal, for example, by means of a band-pass filtering centred on the frequency of the standard resonance wave.

The Applicant has observed that, when a body strikes the blower further to an ingestion, the low pressure rotor connected to the blower responds by vibrating according to its first torsion mode, somewhat like a bell, by emitting a resonance wave, the frequency and the shape are specific to the rotor. Such vibration response further to a brief impact is the impulsion response of the first torsion mode of the low pressure rotor. Thanks to this characteristic response, the vibrational trouble further to the ingestions of bodies can be discriminated from the trouble further to noise or external phenomena, and this, although their influences on the speed R(t) of the low pressure rotor are quasi identical on a global point of view.

Indeed, ingestion or pumping leads to the appearance of oscillations, the overall evolutions are similar when the engine speed is analyzed. Nevertheless, only the oscillations, the shape and amplitude of which are similar to these of the impulsion response of the low pressure rotor correspond to an ingestion of a foreign body.

Further to an ingestion of a foreign body, the dynamic component

Rd(t) of the speed signal R(t) on the low pressure rotor is thus globally presented under the following form:

$$Rd(t)=C(t).\cos(W_T(t)*t+\Phi) \quad (2)$$

In such formula, $C(t).\cos(W_T(t)*t+\Phi)$ is the trouble due to the vibrational response of the low pressure rotor further to the ingestion. Such trouble depends on an amplitude parameter C(t), on a phase parameter Φ and on a pulsation parameter $W_T$ corresponding to the first torsion mode of the low pressure rotor.

The low pressure rotor has several low frequency torsion modes. Upon an ingestion of a foreign body, only the first torsion mode will respond significantly. The impulsion response of the latter will thus constitute a signature characteristic of an ingestion. Further to an ingestion, C(t) will vary strongly according to the following form:

$$C(t)=C.\exp(-t/\tau_T)$$

C is the amplitude of the trouble and is function of the "severity" of the ingestion, the trouble amplitude being very weak with respect to the value of the static speed Rs. The cushioning parameter $\tau_T$ is a function of the cushioning of the first torsion mode of the low pressure rotor and the specific frequency of such mode.

Figure 3:
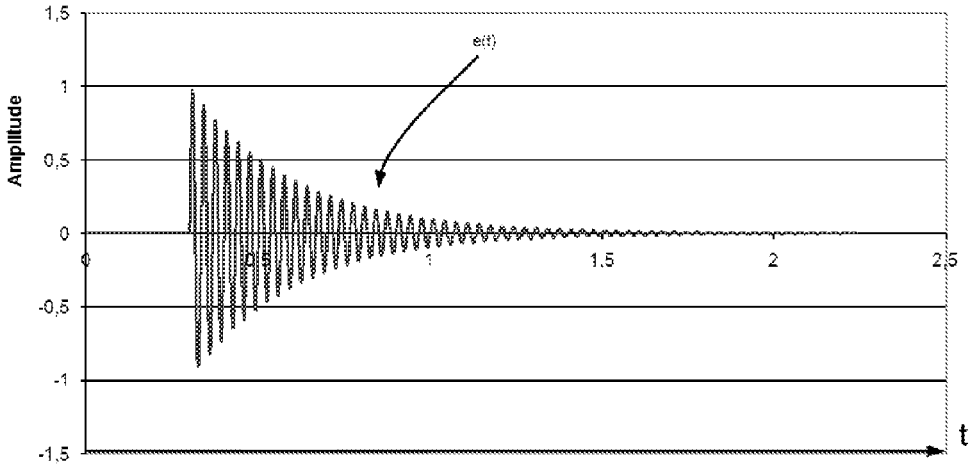
FIG. 3 represents a standard resonance wave of the low pressure rotor.

Thus, upon an ingestion of a foreign body by the engine, the dynamic component Rd(t) of the low pressure rotor strongly resembles to the impulsion response of the first torsion mode e(t) of the low pressure rotor represented on FIG. 3. The impulsion response of the first torsion mode of the rotor e(t) is compared to the dynamic response Rd(t) of the speed R(t) of the low pressure rotor so as to determine if a body has been ingested by the engine. In other words, the filtered dynamic component is compared to a standard resonance wave e(t) of the low pressure rotor so as to obtain an ingestion indicator $T_{ING}$ corresponding to a measurement of resemblance between the standard resonance wave e(t) and the dynamic component Rd(t) of the measured speed signal.

In order to make the comparison, it is necessary to previously determine the standard resonance wave e(t).

According to a first embodiment of the invention, such wave corresponds to the impulsion response of the first torsion mode of the rotor.

According to a first variation, the first torsion mode of the rotor is a "specific" mode, the characteristics (frequency, cushioning) of the first torsion mode being directly measured on the low pressure rotor on which the detection of an ingestion will be implemented, the detection being then carried out "custom-made" with as a standard resonance wave the vibrational impulsion response in the first torsion mode of the rotor. The configuration of the detection method with a specific mode allows a precise detection to be implemented, being adapted to said low pressure rotor. Indeed, each rotor has an impulsion response of its first torsion mode being specific to it. In other words, different rotor models have different impulsion responses.

According to a second variation, the impulsion response of the first torsion mode of the rotor is determined analytically by calculation.

According to a second variation, the standard resonance wave e(t) corresponds to the sum of a plurality of torsion modes of a same low pressure rotor, preferably the two or three first torsion modes of a low pressure rotor. A standard resonance wave e(t) comprising several torsion modes allows to increase the reliability of the detection and the precision thereof.

As an example, to implement the comparison, a convolution product between the dynamic response of the low pressure rotor Rd(t) and the standard wave e(t) is carried out to obtain an ingestion indicator $T_{ING}$.

$$T_{ING}(t)=\int e(u)\cdot R(t-u)\cdot du$$

It goes without saying that other comparison algorithms could also be convenient. Preferably, the comparison algorithms are parameterized to take the distortion of the standard resonance wave (delay, noise, etc.) into account.

Figure 4:
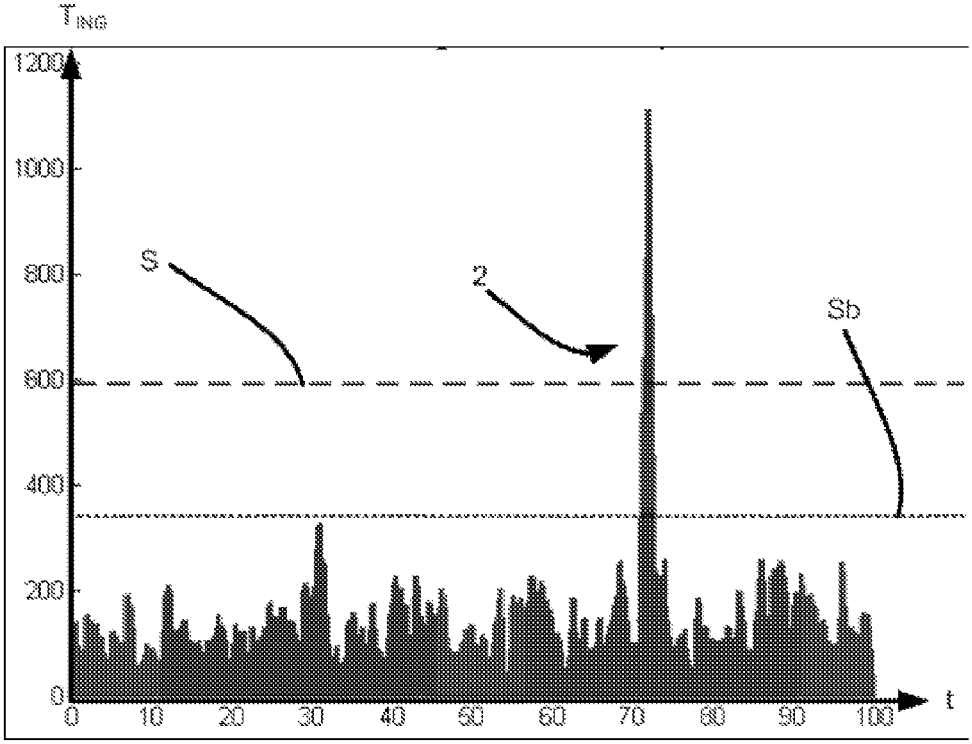
FIG. 4 represents the ingestion indicator corresponding to a resemblance measurement between the dynamic component of the rotor speed and a standard resonance wave of said rotor.

The ingestion indicator $T_{ING}$ represented on FIG. 4 allows the suspect oscillation 2 detected in the measurement of the speed (R(t) of the low pressure rotor to be qualified. More the dynamic response (Rd(t) of the low pressure rotor Rd(t) resembles to the theoretical impulsion response being characteristic of an impact response (here, an ingestion of a foreign body), higher the value of the ingestion indicator $T_{ING}$ will be.

After calculation of the ingestion indicator $T_{ING}$, it is compared to a detection threshold S of a determined value, an ingestion alarm being emitted when the ingestion indicator $T_{ING}$ exceeds said detection threshold S.

The value of the detection threshold S is determined so as not to generate any alarm for values of the indicator $T_{ING}$ corresponding to the normal operation of the engine and that can be qualified as noise. Such detection threshold is thus obtained by applying a margin to the average level of the "noise" Sb. Such margin is a function of the characteristics of the "noise" signal as well of the desired detection reliability level. Referring to FIG. 4, a margin of 70% shares the detection threshold from the average noise level.

Such method is very selective, since the ingestion indicator $T_{ING}$ for a noise signal (out of ingestion) is weak as in the absence of any ingestion, the impulsion response of the first torsion mode is not present in the signal. The noise signal does not resemble to the impulsion response of the first torsion mode.

When an ingestion is detected, the alarm being generated can either be directed to the pilot in the aircraft, on which the engine is mounted, to be consulted in real time, or stored in a memory to be consulted subsequently, for example, in view of an inspection of the engine, or transmitted in real time to the maintenance services of the airline company to allow the latter to anticipated and organized, upon the next stop, a detailed inspection of the impacted engine and every maintenance action being necessary.

It goes without saying that different alarm threshold can be defined so as to make a distinction between different sorts of ingestion (more or less energetic ingestions, more or less severe ingestions).

The invention has been disclosed herein for a double body turbine engine, but it goes without saying that the invention similarly applies to an engine with one rotor or more than two rotors.

The invention claimed is:

1. A method for automated detection of ingestion of at least one foreign body by a gas turbine engine including a rotor, the method comprising:

measuring instantaneous rotational speed of the rotor;

filtering a speed signal of the measured instantaneous rotational speed of the rotor to separate a static component from a dynamic component thereof;

treating the filtered dynamic component of the speed signal and a standard resonance torsion wave of the rotor by a comparison algorithm so as to obtain an ingestion indicator corresponding to a measurement of resemblance between the filtered dynamic component of the speed signal and the standard resonance torsion wave of the rotor, the standard resonance torsion wave of the rotor corresponding to a vibrational impulse response of the rotor further to a brief impact;

comparing the obtained ingestion indicator to a detection threshold; and emitting a foreign body ingestion detection signal indicating that the at least one foreign body has been ingested when the ingestion indicator is higher than the detection threshold.

2. The method according to claim 1, wherein the standard resonance wave of the rotor corresponds to the vibration response of first torsion mode of the rotor.

3. The method according to claim 2, wherein the standard resonance wave is theoretically defined as a function of characteristics of the vibration response of the first torsion mode of the rotor.

4. The method according to claim 2, wherein the standard resonance wave is directly measured on the rotor of the engine on which the detection method is implemented.

5. The method according to claim 1, wherein the filtered dynamic component of the speed signal is in a form of $Rd(t)=C(t).\cos(W_T(t)*+\Phi)$, in which C(t) is an amplitude parameter, $W_T$ is a pulsation parameter, and Φis a phase parameter.

6. The method according to claim 5, wherein the amplitude parameter C(t) is in a form of $C(t)=C.\exp(-t/\tau_T)$ in which C is a trouble amplitude, $\tau_T$ is a function of cushioning of a first torsion mode of the rotor and a specific frequency of the first torsion mode.

7. The method according to claim 1, wherein the rotor is a low pressure rotor of a gas turbine engine, the filtered dynamic component is compared to a standard resonance wave of the low pressure rotor so as to obtain the ingestion indicator, the standard resonance wave corresponding to a vibration response of the low pressure rotor.

8. The method according to claim 1, wherein the foreign body ingestion detection signal is an alarm which is transmitted in real time or stored in a memory.

9. The method according to claim 1, wherein the instantaneous rotational speed of the rotor is measured using a phonic wheel.

10. The method according to claim 1, wherein the instantaneous rotational speed of the rotor is measured using accelerometers arranged in the gas turbine engine.

* * * * *